United States Patent [19]

Runge

[11] Patent Number: 4,615,917

[45] Date of Patent: Oct. 7, 1986

[54] SURFACE PENETRATING FLUOROPOLYMER LUBRICANT

[75] Inventor: Harry V. Runge, Reston, Va.

[73] Assignee: Fluorocarbon Technologies, Inc., Annapolis, Md.

[21] Appl. No.: 722,724

[22] Filed: Apr. 11, 1985

[51] Int. Cl.[4] ..... B05D 3/02

[52] U.S. Cl. ..... 427/385.5; 208/18; 252/12; 252/58; 427/388.5

[58] Field of Search ..... 427/385.5, 388.5; 252/49.8, 49.9, 12, 12.2, 12.6, 58; 208/18, 19, 22, 23

[56] References Cited

U.S. PATENT DOCUMENTS

| | | | |
|---|---|---|---|
| 3,159,577 | 12/1964 | Ambrose et al. | 252/58 |
| 3,445,393 | 5/1969 | Hinds | 252/58 |
| 3,573,230 | 3/1971 | Voorhees | 427/385.5 X |
| 3,843,534 | 10/1974 | Gates et al. | 252/49.8 X |
| 3,904,575 | 9/1975 | Satokawa et al. | 260/32.8 R |
| 4,127,491 | 11/1978 | Reick | 252/16 |
| 4,203,856 | 5/1980 | Pardee | 252/58 X |
| 4,284,518 | 8/1981 | Reick | 252/16 |
| 4,333,840 | 6/1982 | Reick | 252/16 |
| 4,349,444 | 9/1982 | Reick | 252/16 |
| 4,362,634 | 12/1982 | Berens et al. | 252/49.5 |
| 4,396,514 | 8/1983 | Randisi | 252/30 |
| 4,444,649 | 4/1984 | Dvoracek | 252/49.8 X |
| 4,465,607 | 8/1984 | Cottell | 252/58 |
| 4,472,290 | 9/1984 | Caporiccio et al. | 252/49.9 X |

FOREIGN PATENT DOCUMENTS 2090284 7/1981 United Kingdom .

OTHER PUBLICATIONS

Vapor Degreasing with Chlorothene VG Solvent, published by Dow Chemical Company.

Orr, W. K.; J. H. McGee, "Racing Yacht Drag Reduction Holds Promise for Larger Vessels" Sea Technology, Jan. 1984.

Orr, W. K.; J. H. McGee, "Corrosion Treatment May Offer Electrochemical Protection" Sea Technology, Jun. 1984.

*Primary Examiner*—Thurman K. Page

*Attorney, Agent, or Firm*—Willian Brinks Olds Hofer Gilson & Lione Ltd.

[57] ABSTRACT

The invention is a composition for coating surfaces with a thin film containing fluoropolymer particles, a method for producing this composition, as well as a method for applying it to a surface. More particularly, the composition includes a carrier lubricant, such as mineral oil, which has particles of a fluoropolymer, such as polytetrafluoroethylene, well dispersed within it. A solvent, such as 1,1,1-trichloroethane, is blended with the fluoropolymer containing carrier lubricant, most preferably in a one to one ratio. The result is a low viscosity dispersion of the carrier lubricant, which itself has a dispersion of the fluoropolymer particles. When the composition is applied to a surface, the lowered viscosity aids in obtaining a thinner film of the lubricant and also enhances the penetration of the lubricant into the surface. Advantageously, the solvent is allowed to evaporate from the surface, thus leaving an even thinner film of the lubricant. Also, the evaporation of the solvent returns the lubricant to a higher viscosity which is better retained on the surface. Preferably, the lubricant also contains a phosphate ester, such as tricresyl phosphate, which is thought to aid in dispersing the fluoropolymer particles in the lubricant, and in attaching the fluoropolymer particles to the surface.

28 Claims, No Drawings

SURFACE PENETRATING FLUOROPOLYMER LUBRICANT

BACKGROUND OF THE INVENTION

The present invention relates to the field of lubricants and protective coatings. More particularly, the invention relates to lubricants and protective coatings incorporating fluoropolymer particles.

Fluoropolymers, such as polytetrafluoroethylene, have gained widespread acceptance for reducing surface friction and as protective coatings. In particular, polytetrafluoroethylene (PTFE) has been used on various types of surfaces from the familiar frying pan to rubbing parts and valves in complex apparatus, such as artificial human hearts. Unfortunately however, the cost of either making entire parts from PTFE or applying PTFE coatings to existing surfaces is relatively expensive.

Considerable research has been undertaken involving the incorporation of minute solid fluoropolymer particles in liquid lubricants to thereby achieve some of the benefits of the fluoropolymers in a liquid medium. In particular, several engine oil additives which include dispersed particles of fluoropolymers are disclosed in the patent literature. For example, U.S. Pat. No. 3,933,656 to Reick, teaches a modified lubricant for an internal combustion engine which comprises a major amount of a conventional motor oil, with a minor amount of sub-micron size PTFE particles, and a neutralizing agent to stabilize the dispersion to prevent agglomeration and coagulation of the particles. In this and several other patents, the theory is proposed that the lubricating action of the PTFE containing lubricant is enhanced by virtue of the fact that the PTFE particles somehow become attached to the surfaces of the engine thus lubricated, thereby creating a renewable coating of PTFE.

Naturally, substantial effort has been expended in this field to optimize the effectiveness of these PTFE containing lubricants as well as to minimize the problems associated therewith. In particular, much has been done to prevent the otherwise inherent problems of agglomeration, coagulation, and settling of the PTFE particles. For example, British Patent Application No. 2,090,284 teaches the method of coating the PTFE particles with a "buoyant" carrier with a relatively low specific gravity, after which the coated PTFE particles are dispersed in a heavier oil, i.e. one with a higher specific gravity such as mineral oil. In this way, the PTFE particles which have an even higher specific gravity are "floated" in the oil. For examples of other methods of obtaining a dispersion of PTFE particles in a carrier lubricant see U.S. Pat. Nos. 4,127,491; and 4,396,514.

One limitation with many of the PTFE containing lubricants involves the fact that the oils used to achieve and maintain good dispersion of the particles have been of relatively high viscosity. These high viscosity oils, although well suited for applications such as in crankcases for automobiles, are undesirable for other applications such as for lubricating weapons or for coating exposed surfaces for corrosion protection. Also, the high viscosity oils are difficult if not impossible to apply in a spray format, particularly without the use of a high pressure aerosol container. Furthermore, the higher viscosity oils display a more limited amount of surface penetration.

U.S. Pat. No. 4,333,840 to Reick, discloses a "hybrid PTFE lubricant" wherein the viscosity of a PTFE containing lubricant was lowered by blending with the original PTFE oil a second oil of lower viscosity. This patent recites the advantage that the lower viscosity PTFE oil is better suited for use with weapons, particularly as a lubricant and a means to prevent fouling.

Although the hybrid PTFE oil disclosed by Reick has a lower viscosity and may therefore be better suited for certain applications such as weapons, it also faces certain limitations. In particular, because the oil is now of a lower total viscosity, its retention on surfaces will likely be limited. That is, the lighter oil carrier for the PTFE tends to be more easily removed from the surfaces to which it is applied.

SUMMARY OF THE INVENTION

The present invention is a composition for applying a thin film containing solid particles of a fluoropolymer, a method for preparing this composition, as well as a method for coating a surface with a thin film containing solid particles of a fluoropolymer.

Briefly, the composition comprises a mixture of a carrier lubricant medium, such as mineral oil; a quantity of fluoropolymer particles, such as ground and sintered particles of polytetrafluoroethylene, which are well dispersed in the carrier lubricant; and a solvent, such as a vapor degreasor, which dilutes the carrier lubricant and also is adapted to evaporate after the composition is applied to a surface.

In accord with one embodiment of the invention, the carrier lubricant is based on a 50 weight mineral oil. The fluoropolymer particles comprise ground and sintered polytetrafluoroethylene (PTFE) particles in the size range of between about 0.5 microns to about 20 microns. It is important that these particles be well dispersed in the carrier lubricant in order to prevent coagulation, agglomeration, and/or settling. Also, a quantity of tricresyl phosphate is added to the lubricant carrier for the purposes of improving the dispersion of the PTFE particles in the lubricant carrier and enhancing the attachment of the PTFE particles to the surface. The solvent component of the composition comprises 1,1,1-trichloroethane with an inhibitor added to prevent degradation of the 1,1,1-trichloroethane. Such a solvent is currently marketed by THE DOW CHEMICAL COMPANY under the tradename of "Chlorothene VG". (Both "Chlorothene" and "Chlorothene VG" are considered trademarks by THE DOW CHEMICAL COMPANY.) Because of its relatively low toxicity and its nonflammability, this Chlorothene VG solvent has been found particularly well suited for use in the present invention.

Briefly, the method of producing the composition comprises the steps of: providing a carrier lubricant, dispersing a quantity of fluoropolymer particles in the carrier lubricant, and adding a quantity of a solvent which is capable of diluting the carrier lubricant and is adapted to evaporate after the composition is applied to a surface.

In accord with another embodiment of the invention the method involves the steps of dispersing the PTFE particles with the aid of an oil with a lower specific gravity to thereby "float" the particles in the higher specific gravity carrier lubricant. Also, the dispersion of the PTFE particles in the carrier lubricant is enhanced by the addition of dispersant compounds such as phosphate esters, preferably tricresyl phosphate, which also are thought to aid in attaching the PTFE particles to the surfaces to be lubricated and protected. After the dispersion of the PTFE particles is achieved in the carrier lubricant, the solvent, preferably Chlorothene VG, is added, thereby diluting or "thinning" the PTFE containing lubricant. As a result, a PTFE lubricant is provided with a temporarily lower viscosity as the solvent will evaporate after application to the surface.

Briefly, the method of coating a surface with a thin film containing fluoropolymer particles comprises the steps of providing a carrier lubricant with particles of a fluoropolymer dispersed therein; adding a solvent to dilute the carrier lubricant; applying the mixture to a surface; and allowing the solvent to evaporate from the mixture.

In yet another embodiment of the invention, the method of coating includes an applying step wherein the mixture is sprayed onto the surface. Also in this embodiment, after spraying the mixture onto the surface, the surface is wiped to remove excess carrier lubricant.

DESCRIPTION OF THE PREFERRED EMBODIMENTS

The following is a description of the preferred embodiments of the present invention. At present, one preferred method of producing the coating composition of the present invention is to start with a lubricant with particles of polytetrafluoroethylene already well dispersed therein. Particularly, the preferred composition of this fluoropolymer containing lubricant is that composition described as the preferred lubricant in British Patent Application No. 2,090,284, which application is incorporated herein by reference. It is believed that the PTFE containing oil presently marketed by TRIBOPHYSICS CORPORATION of Wayne, N.J. under the tradename of "T12" is produced according to the preferred embodiment of this British Patent Application. Thus, in the most preferred embodiment, a quantity of this "T12" oil is used as the fluoropolymer lubricant of the present invention.

Other PTFE containing lubricants which have varying properties in the carrier lubricant and the PTFE particles are commercially available, for example "TUFOIL" by FLUORAMICS, Inc., "WGL" by ALEGRIA of Florida, and "FOMBLIMY FLUIDS" by MONTEFLUOS of the MONTEDISON GROUP. Accordingly, it may be desirable, based on the particular needs of the application, to use these others to produce the coating composition of the present invention.

In another preferred embodiment the coating composition is produced by starting with the fluoropolymer particles and then adding the carrier lubricant to them. Most preferably, the fluoropolymer particles are mixed with the carrier lubricant in a similar process as that described in the British Patent Application No. 2,090,284. In this preferred method, the particles of a fluoropolymer are ground and sintered particles of polytetrafluoroethylene (PTFE). Ground PTFE particles are used because of their durability and because of their inertness and electrostatic neutrality, the latter characteristics being important in keeping the particles from agglomerating. In addition, the particles are sintered because sintered PTFE particles typically have smoother surfaces and a more uniform geometry than non-sintered particles.

The size of the PTFE particles is selected in consideration of at least two factors. First, the particle size is selected to be best suited for the particular application. Since one of the theories of operation of the present invention is that the PTFE particles actually become attached within the pores of the surface thus coated, the particle size may be altered to optimize the effects on particular types of surfaces. Second, it has been found to be more difficult to keep the larger size PTFE particles dispersed in the carrier lubricant. Preferably, the PTFE particles have an estimated spherical diameter of 5 microns and below for about 90% of the particles.

PTFE particles manufactured by LIQUID NITROGEN PRODUCTS CORPORATION of Philadelphia, Pa., under the designation TL 102 have proven particularly well suited in this preferred embodiment. These PTFE particles are supplied in powder form. Preferably, the PTFE particles are wetted with a compound such as aliphatic naptha or kerosene before they are mixed with the lubricant. This wetting step has been shown to help separate the particles and thereby inhibit agglomeration.

In the next step, the PTFE particles become coated with a relatively low specific gravity oil. The purpose of this step is to prevent or at least slow down the settling of the PTFE particles out of the carrier lubricant. One of the problems of providing good dispersions of PTFE particles in lubricants involves the fact that PTFE has a relatively high specific gravity which naturally leads to settling of the particles. As disclosed in British Patent Application No. 2,090,284, one solution to this problem is to first coat the particles with an oil having a relatively low specific gravity. In this way, the coated particles have a lowered effective specific gravity, preferably equal to the specific gravity of the carrier lubricant. As a result, the coated particles are "floated" in the carrier lubricant. As stated above, this dispersion method is taught in British Patent Application No. 2,090,284, and accordingly forms no part of the present invention. Also as stated above, other methods of dispersing fluoropolymer particles have been taught and may be more desirable to use depending on the requirements of the specific application.

Specifically, the most preferred oil used to coat the particles as described above is an oil marketed by EXXON Corp. under the tradename "Faxam". This oil was selected on the basis of its high quality and has a viscosity of 70 weight.

As taught in the British Application referred to above, the low specific gravity oil is added to the wetted PTFE particles and then the mixture is blended at high speed, preferably at 4,000 rpm in a standard dispersion mixer. While the mixture is being blended, a vacuum is drawn at least 29.8 inches at standard barometric pressure of 29.92 inches. It is reported that when producing 50 gallons of the mixture, that 30 minutes of this blending and vacuum will be required.

Next, another lubricant is added and the resultant mixture is sheared and vacuumed for 15 minutes. This lubricant can consist entirely of a mineral oil, or alternatively can consist entirely of a phosphate ester, preferably tricresyl phosphate or triaryl phosphate. Most preferably, it consists of a 2 to 1 blend of mineral oil with tricresyl phosphate. The mineral oil used in the most preferred embodiment has a viscosity of 20 to 50 weight and is widely available. The tricresyl phosphate can be obtained from STAUFFER CHEMICAL CO. under the designation 8484. This tricresyl phosphate is a synthetic phosphate ester.

Tricresyl phospate has important advantages when used in this invention. For years, it has been used as an additive for high pressure oils and greases. Also, it has been shown that tricresyl phosphate tends to attach to scarred places, in a cylinder wall for example, and prevents further abrasion in that area. For this reason, it is theorized by the inventor that the tricresyl phosphate aids in bonding the PTFE particles to the surfaces to be coated. It has also been found that triaryl phosphate performs about as well as tricresyl phosphate and may therefore be desirable to use because of its lower price. Triaryl phosphate, which is a synthetic substitute for tricresyl phosphate, can also be obtained from the STAUFFER CHEMICAL CO. with a designation of 8478.

The preferred proportions of this PTFE containing lubricant are as follows: 1 part coated PTFE particles to 1 part tricresyl phosphate to 2 parts mineral oil. As mentioned in the British application, the easiest way to achieve the proper amount of the particle coating oil is to add an excess of the coating oil and allow it to rise to the top of the mixture after the two oils have been blended.

As an alternative preferred embodiment, when the PTFE containing lubricant is made without mineral oil in the higher specific gravity medium, the following shows the amounts required:

PTFE particles: 3 grams
aliphatic naptha: 3 grams
SHELL aviation grade 50 wt. oil: 1.8 fluid ounces
tricresyl phosphate: 2.0 fluid ounces In other alternative embodiments, the PTFE particles can comprise between 2 and 25 volume percent of the lubricant.

At this point, what has been produced is a relatively high viscosity PTFE containing lubricant which has utility in and of itself as a lubricant or a lubricant additive. It is important to note that this PTFE containing lubricant thus produced has been disclosed in the British Patent Application No. 2,090,284. Likewise, it is believed that the oil marketed by TRIBOPHYSICS CORP. of Wayne N.J., under the tradename "T12" is also made according to the process disclosed in this British application. Accordingly, neither this process nor the composition of the PTFE oil thus produced is considered part of the present invention. Although presently considered preferable to either obtain this particular PTFE containing lubricant or to produce it according to the above described process, it should be clear that the inventor considers it within his invention to either start with other PTFE containing lubricants or to produce a PTFE containing lubricant according to other methods.

Once the PTFE containing lubricant is obtained, a quantity of a solvent is added to dilute that lubricant. Preferably the solvent comprises a halogenated hydrocarbon in liquid form. Most preferably, the solvent is a form of 1,1,1-trichloroethane presently produced by THE DOW CHEMICAL CO. and sold under the tradename of "Chlorothene VG". The Chlorothene solvent is a proprietary product of DOW primarily sold for vapor degreasing and cold cleaning operations. According to product literature, Chlorothene VG is constituted of about 94% 1,1,1-trichloroethane, has a maximum of 1% of halogenated impurities, and incorporates an "inhibitor" system for stabilizing its composition.

Chlorothene VG is the most preferred solvent to add to the fluoropolymer containing lubricant in the present invention for at least three reasons. First, it has been shown that chlorothene is capable of dissolving the PTFE containing lubricant to a sufficient extent to be well suspended within the solvent/lubricant mixture without causing settling, coagulation, or agglomeration of the PTFE particles. This has been a somewhat surprising result in that it was thought that, once the lubricant was dissolved, the PTFE particles would irreversibly settle out, agglomerate, or coagulate. However, it was found that the Chlorothene could be added in quantities up to 16 parts chlorothene to one part PTFE lubricant without experiencing coagulation or agglomeration problems. It was noted that, at the higher concentrations of chlorothene, there was some settling occurring if the containers were left undisturbed for long periods. However, the PTFE particles were easily put back into dispersion by simply shaking the containers.

The second and third reasons that chlorothene is most preferred as the solvent in the present invention is that it has relatively low toxicity and is nonflammable. These two criteria are important because many uses for the present invention will involve a spraying operation wherein the solvent is allowed to evaporate.

In The Merck Index (9th Ed.), "Chlorothene" is listed as a common name for 1,1,1-trichloroethane. Also in the Merck Index, 1,1,1-trichloroethane is reported to be nonflammable with a freezing point of −32.5° C., a boiling point of 74.1° C., and no flash point. According to the product literature from DOW, the inhibitor system in chlorothene is selected to have similar thermal properties as the 1,1,1-trichloroethane.

The solvent is added to the PTFE containing lubricant in proportions ranging from 1 part solvent to 2 parts lubricant all the way to 16 parts solvent to 1 part lubricant. Preferably, the solvent is present in a range between 1 part solvent to 1 part lubricant and 8 parts solvent to 1 part lubricant. A 1:1 solvent to lubricant ratio is most preferred. As mentioned it was found that, at the higher concentrations of solvent, such as those above 16 parts solvent to 1 part lubricant, there was some settling of the particles if containers of the mixture were left undisturbed for long periods of time, such as 6 months. However, in these cases, the particles were easily redispersed with simple agitation of the liquid. This minor settling should be contrasted with agglomeration or coagulation wherein, once the particles have become separated, they cannot be redispersed through any amount of agitation. It is therefore an important advantage of the present invention that the PTFE particles remain well dispersed over long periods of time and that even when there is some sedimentation, it is not irreversible or serious.

The solvent may be blended with the PTFE containing lubricant through simple techniques. For example, small amounts have been mixed with a common "whisk" chucked in an ordinary handheld electric drill. The solvent and lubricant mixture is blended this way for about 5 minutes at relatively high speed. This blending is important in creating an even dispersion of the PTFE lubricant within the solvent.

The resultant blend is a homogeneous mixture of the PTFE containing lubricant and the solvent. This mixture may be stored in polyethylene or metal containers, or any other type of container which is not affected by the chlorothene solvent.

As stated briefly above, the composition of the present invention is useful as a surface lubricant and/or protective coating. In particular, because the composition of the present invention comprises a PTFE containing lubricant which is now in a temporarily diluted medium, the PTFE lubricant may be applied to surfaces in a wider variety of ways. In other words, the composition of this invention includes a lubricant with a dispersion of PTFE particles, which lubricant has itself been dispersed in a less viscous medium, the solvent. In addition, because the solvent used is intentionally volatile, the solvent evaporates after application, thereby returning the lubricant to its original viscosity. This is thought to be highly beneficial as it allows the lubricant to be applied in thin films to a wider variety of surfaces. Also, the temporary lowering of the viscosity is thought to be important in allowing the PTFE lubricant to better penetrate the pores of the surfaces to be coated, with the added benefit that once in the pores of the surface, the solvent evaporates whereby the lubricant is more likely to remain in the pores. Expressed in yet another way, the invention allows one to apply a PTFE lubricant in just the right amount to just the right spot.

The preferred method of applying the composition of the invention is as follows. First, a quantity of the composition as described above is obtained. The composition is then applied to a clean surface, preferably by spraying. It is desirable to clean, most preferably with chlorothene VG, the surface to be coated before applying the composition.

To actually apply the composition, spraying is preferred. In particular, when doing small surfaces, a hand operated pump sprayer works satisfactorily. An advantage of this invention is that because the viscosity of the lubricant is temporarily lowered to such an extent, the lubricant can be sprayed without the aid of a pressurized aerosol container. This advantage is important in that there are certain environments, such as on board an airplane, where pressurized aerosol containers are undesirable.

For larger jobs, the composition may be sprayed using a motorized compressor and spray gun. Alternatively, the composition can be painted on with a brush or cloth, or it can be applied by dipping the surface to be coated.

Preferably, the composition and the surface to be coated should be at least 60° F. In order to best facilitate adsorption and penetration, the temperature should be between 90° and 100° F. Particularly, it has been observed that the surface is less tacky when it has been applied at these higher temperatures, perhaps indicating less oil left on top of the surface.

As stated above, after the composition is applied to the surface, the solvent evaporates, thus leaving only the PTFE lubricant on (or in) the surface. Most preferably, the surface is also wiped after the composition is applied to it in order to remove excess lubricant. This wiping step is also important for working the lubricant into the surface. That is, it is beneficial to apply heat and pressure to the surface to enhance penetration of the lubricant into the surface.

It should be noted that not all materials are compatible with the solvents used in the invention. It is deemed within the ordinary skill in the art to either obtain data from the manufacturer of the solvent or to perform experiments to determine the compatibility of the solvent with the particular surface. For example product literature for Chlorothene VG is available which lists the effects if any when it comes in contact with different materials. Generally, chlorothene has been found to be compatible with most surfaces for which the product is intended to be used, particularly considering the fact that the chlorothene does not remain in contact with the surface for very long. For example, the chlorothene may be used on painted or unpainted metal, fiberglass, various resins, etc.

In addition, it should be noted that when working with any volatile solvent, one should take care to avoid overconcentration of the solvent in the working environment. It is considered within the ordinary skill in the art to become aware of and follow the safety precautions prescribed by the manufacturer of the solvent used.

The observed result of applying the composition to a surface is that a thin film of PTFE containing lubricant is thereby deposited on the surface. While not wishing to be bound by any particular theory, the inventor has theorized that the individual particles of PTFE are in some way attached to the surface, and particularly within the pores of the surface. This is thought to be why the lubricating and coating layer works well even after the surface is wiped clean of the "free" oil. Also, when using tricresyl or triaryl phosphate, it is thought that these phosphate esters somehow enhance the bonding of the PTFE particles to the surface. This condition of having the PTFE particles bonded to the surface lowers the coefficient of friction of the surface. Naturally, this is beneficial for rubbing surfaces. In addition, it has also been shown to reduce fluid drag on the surface. Such a result is highly beneficial in weapons lubrication.

It has also been observed that coating a surface with the composition of the invention has significant anticorrosion benefits. In particular, considerable corrosion testing of the composition of this invention has been conducted in accordance with Military Specification MIL-STD-810C. This testing has involved dissimilar metal combinations; aluminum alloys, stainless steel, copper, high carbon steels, cold rolled steel, and aircraft wing sections. The surfaces coated as described above with the composition of this invention have demonstrated significant and reproducible control of corrosion.

Although the precise physical processes or mechanisms producing these results are not fully understood by the inventor, the inventor's current hypothesis is as follows. It is known that PTFE is highly hydrophobic. As a result, it is thought that the particles of PTFE which attach within the pores of the surface repel and possibly replace the water in the pores. It is also thought that the phosphate esters, such as tricresyl phosphate, used in the preferred embodiments, in some way contribute to this protection of the coated surface, although the mechanism is not understood.

In regard to corrosion protection, it is considered important that the addition of the solvent to the fluoropolymer lubricant has allowed the lubricant to better penetrate the surface and thereby provide improved corrosion protection. Likewise, it is considered important that the solvent evaporates and leaves a less viscous lubricant which is better retained on the surface.

EXAMPLES

As an example of the present invention, four fluid ounces of Chlorothene VG (157.6 grams) were gradually added to four fluid ounces of the PTFE containing lubricant marketed as "T12" (122 grams). These two components were blended with a "whisk" rotated at high speed by a handheld electric drill for 5 minutes.

The blending was carried out at room temperature which was approximately 70° F. Eight fluid ounces of a well dispersed liquid were obtained.

For a specific example of the capacity of the present invention for corrosion protection, two Smith & Wesson 38 special revolvers were used to observe the effects of salt water immersion. One of these revolvers was thoroughly coated with the composition of the most preferred embodiment; the other was treated with conventional hydrocarbon lubricants. Both weapons were suspended in ocean water at 75° F. in Florida for 120 hours. The weapon treated with the lubricant of the present invention was removed from the ocean, and after drying, was successfully fired. Additionally, there were no observable corrosion effects. The other weapon was inoperable and severely corroded.

In addition to the corrosion tests referred to above, numerous tests were carried out by the inventor in the area of weapons lubrication. In summary form, the inventor found that the parameters of muzzle velocity, accuracy, rates of fire for automatic weapons, component wear, component fouling, and projectile penetration could all be noticeably improved by using the composition of the present invention rather than conventional weapons lubricants. Some of these improvements are thought to be a result of lowering the coefficient of friction in the weapon's barrel, while others are thought to be a result of the corrosin protection provided by the composition.

It should be noted that, although much of the discussion has dealt with the lubrication and protective coating of weapons, the invention is not limited to these applications. In addition, although much of the discussion has involved the use of the specific PTFE containing lubricant marketed as "T12", the invention is not limited to using this particular fluoropolymer lubricant. Furthermore, although much of the description above has involved the use of the solvent marketed as "Chlorothene VG", the use of other solvents is within the scope of this invention. In sum, it should be born in mind that the above description of the specific embodiments and examples are to be interpreted as exemplary and explanatory rather than limiting. Certainly, it is the following claims which define the scope of the present invention.

I claim:

1. A composition for coating a surface with a thin film containing particles of a fluoropolymer comprising:

a dispersion comprising a carrier lubricant medium and fluoropolymer particles; and a solvent means for diluting said dispersion, said solvent being adapted to evaporate after application of the composition to the surface.

2. The composition of claim 1 wherein the fluoropolymer particles comprise polytetrafluorethylene.

3. The composition of claim 2 wherein the particles are ground and sintered.

4. The composition of claim 1 wherein the carrier lubricant comprises mineral oil.

5. The composition of claim 4 wherein the carrier lubricant medium further comprises a phosphate ester.

6. The composition of claim 5 wherein the phosphate ester is selected from the group consisting of tricresyl phosphate and triaryl phosphate.

7. The composition of claim 1 wherein the carrier lubricant comprises a phosphate ester.

8. The composition of claim 7 wherein the phosphate ester is selected from the group consisting of tricresyl phosphate and triaryl phosphate.

9. The composition of claim 1 wherein the solvent means is nonflammable.

10. The composition of claim 1 wherein the solvent means comprises 1,1,1-trichloroethane.

11. The composition of claim 1 wherein the proportion of solvent means to carrier lubricant medium is between about 1 to 2 and 16 to 1.

12. The composition of claim 1 wherein the proportion of solvent means to carrier lubricant medium is between about 1 to 1 and 8 to 1.

13. The composition of claim 1 wherein the proportion of solvent means to carrier lubricant medium is about 1 to 1.

14. A composition for coating a surface with a thin film containing particles of a fluoropolymer comprising:

a dispersion comprising a carrier lubricant medium and a quantity of polytetrafluoroethylene particles, said medium comprising a mixture of mineral oil and a phosphate ester selected from the group consisting of tricresyl phosphate and triaryl phosphate; and a solvent means comprising 1,1,1-trichloroethane for diluting said dispersion, said solvent means being adapted to evaporate after application of the composition to the surface.

15. The composition of claim 14 wherein the proportion of solvent means to carrier lubricant medium is between about 1 to 2 and 1 to 16.

16. The composition of claim 14 wherein the proportion of solvent means to carrier lubricant medium is between about 1 to 1 and 8 to 1.

17. The composition of claim 14 wherein the proportion of solvent means to carrier lubricant medium is about 1 to 1.

18. The composition of claim 14 wherein the proportion of mineral oil to phosphate ester is about 2 to 1.

19. A method of producing a composition for coating a surface with a thin film containing particles of a fluoropolymer comprising:

providing a dispersion comprising particles of a fluoropolymer and a carrier lubricant medium;

providing a solvent means which is capable of diluting said dispersion and is adapted to evaporate after application of the composition to the surface; and mixing the solvent means with said dispersion so that said dispersion is well dispersed in said solvent.

20. The method of claim 19 wherein said particles of a fluoropolymer remain substantially dispersed in the carrier lubricant medium.

21. The method of claim 19 wherein the particles comprise ground and sintered polytetrafluoroethylene.

22. The method of claim 19 wherein the carrier lubricant medium comprises a mixture of mineral oil and a phosphate ester selected from the group consisting of tricresyl phosphate and triaryl phosphate.

23. A method of producing a composition for coating a surface with a thin film containing particles of a fluoropolymer comprising:

providing a dispersion comprising particles of a polytetrafluoroethylene and a carrier lubricant medium, the medium comprising a mixture of mineral oil and a phosphate ester selected from the group consisting of tricresyl and triaryl phosphate;

poviding a solvent means comprising 1,1,1-trichloroethane which means is capable of diluting the dispersion and is adapted to evaporate after application of the composition to the surface; and mixing the solvent means with the dispersion so that said dispersion is in turn well dispersed in said solvent means.

24. A method of coating a surface with a thin film containing particles of a fluoropolymer comprising the steps of:

providing a dispersion comprising particles of a fluoropolymer and a carrier lubricant medium;

providing a solvent capable of diluting the dispersion and which is adapted to evaporate after application to the surface;

mixing the dispersion with the solvent to form a mixture such that said dispersion is well dispersed in said solvent; and applying the mixture to a surface after which substantially all of the solvent evaporates thereby leaving a thin film containing the particles of a fluoropolymer on the surface.

25. The method of claim 24 wherein the surface is wiped after application of the mixture to remove excess carrier lubricant medium.

26. The method of claim 24 wherein the fluoropolymer particles comprise ground and sintered polytetrafluoroethylene.

27. The method of claim 24 wherein the carrier lubricant medium comprises a mixture of mineral oil and a phosphate ester selected fom the group consisting of tricresyl phosphate and triaryl phosphate.

28. The method of claim 24 wherein the mixture is applied to the surface by spraying.

* * * * *